US006806446B1

(12) United States Patent
Neale

(10) Patent No.: US 6,806,446 B1
(45) Date of Patent: Oct. 19, 2004

(54) POWER MANAGEMENT CONTROLS FOR ELECTRIC APPLIANCES

(76) Inventor: Stephen D. Neale, 2600 S. Hardy Dr., Scottsdale, AZ (US) 85282

( * ) Notice: Subject to any disclaimer, the term of this patent is extended or adjusted under 35 U.S.C. 154(b) by 59 days.

(21) Appl. No.: 10/264,390

(22) Filed: Oct. 4, 2002

(51) Int. Cl.[7] ..... H05B 1/02

(52) U.S. Cl. ..... 219/497; 219/485; 392/485; 307/39

(58) Field of Search ..... 219/497, 485, 219/488; 392/485–487; 307/31–35, 38–39, 41

(56) References Cited

U.S. PATENT DOCUMENTS

| | | | | | |
|---|---|---|---|---|---|
| 3,952,182 | A | | 4/1976 | Flanders | |
| 4,090,088 | A | * | 5/1978 | McMahon et al. | 307/38 |
| 4,168,491 | A | * | 9/1979 | Phillips et al. | 340/501 |
| 4,245,319 | A | * | 1/1981 | Hedges | 700/296 |
| 4,283,635 | A | * | 8/1981 | Balmer | 307/35 |
| 4,336,462 | A | * | 6/1982 | Hedges et al. | 307/35 |
| 4,464,724 | A | * | 8/1984 | Gurr et al. | 700/291 |
| 4,480,173 | A | | 10/1984 | Butterfield | |
| 4,567,350 | A | | 1/1986 | Todd, Jr. | |
| 4,762,980 | A | | 8/1988 | Insley | |
| 4,819,180 | A | * | 4/1989 | Hedman et al. | 700/291 |
| 4,829,159 | A | * | 5/1989 | Braun et al. | 219/486 |
| 4,950,974 | A | * | 8/1990 | Pagano | 323/222 |
| 5,207,071 | A | * | 5/1993 | Ozu et al. | 62/175 |
| 5,325,822 | A | | 7/1994 | Fernandez | |
| 5,397,926 | A | * | 3/1995 | Matsui et al. | 307/32 |
| 5,408,578 | A | | 4/1995 | Bolivar | |
| 5,437,003 | A | | 7/1995 | Blanco | |
| 5,443,206 | A | | 8/1995 | Cohen | |
| 5,504,306 | A | | 4/1996 | Russell et al. | |
| 5,625,236 | A | * | 4/1997 | Lefebvre et al. | 307/41 |
| 5,675,503 | A | * | 10/1997 | Moe et al. | 700/296 |
| 5,770,895 | A | * | 6/1998 | Kumasaka | 307/32 |
| 5,784,531 | A | | 7/1998 | Mann et al. | |
| 5,866,880 | A | | 2/1999 | Seitz et al. | |
| 6,178,291 | B1 | | 1/2001 | Zenios et al. | |
| 6,246,831 | B1 | | 6/2001 | Seitz et al. | |
| 6,308,009 | B1 | | 10/2001 | Shellenberger et al. | |
| 6,670,584 | B1 | * | 12/2003 | Azizeh | 219/485 |

FOREIGN PATENT DOCUMENTS

| | | | |
|---|---|---|---|
| JP | 11-98683 | * | 4/1999 |
| WO | WO 92/10071 | | 6/1992 |
| WO | WO 97/14003 | | 4/1997 |
| WO | WO 99/40375 | | 8/1999 |
| WO | WO 00/77456 | | 12/2000 |

* cited by examiner

*Primary Examiner*—John A. Jeffery
(74) *Attorney, Agent, or Firm*—Frank J. McGue

(57) ABSTRACT

A power management system comprises a microprocessor and a current flow sensor in electrical communication therewith. The current flow sensor measures the amount of electrical current available to the building as well as the actual current flowing through the building. A load sensor is in electrical communication with the microprocessor and measures the load requirements of the appliance. One or more switches are electrical communication with the microprocessor and control the power flowing to the appliance. The microprocessor maintains a record of the information from the load sensor and the current sensor and further has a electrical maximum limit and a continuous load limit for the building. The microprocessor uses the one or more switches to average a continuous load over a preset period of time which is less than the continuous load limit for said building while never exceeding the electrical maximum limit for said building.

11 Claims, 4 Drawing Sheets

POWER MANAGEMENT CONTROLS FOR ELECTRIC APPLIANCES

TECHNICAL FIELD

This invention relates in general to power management controls, and, more particularly, to power management controls for electric water heaters.

BACKGROUND OF THE INVENTION

Power management control systems generally are designed to regulate the electrical energy consumed by an electric water heater based upon the electrical energy available to that heater. Some products, often termed energy management systems, are used to manage electrical usage over a period of time or to limit the maximum energy used.

For example, a typical residence may have several electrical appliances which consume large amounts of electrical energy. Some examples include refrigerators, freezers, hot water heaters, furnaces, and air conditioners. In an effort to average the electrical power usage for a home, such appliances may be turned off or allowed to operate under the control of an energy management system. Such limitations can average electrical power usage over time or simply limit the usage during certain periods of time.

Energy management systems in use today have become quite sophisticated, using input as diverse as external temperatures, utility rates and electrical power limits to control appliances. In general, most energy management systems are highly flexible and are not dedicated to specific requirements.

Currently, it is necessary to consult building codes to determine the size of the electrical feeder line to supply a residence or other building. Most often, local building codes are derived from the National Electrical Code published by the National Fire Protection Association. That code defines the calculated load of a residence or other dwelling to be a percentage of the nameplate ratings of the permanent appliances plus a volt-ampere rating per square foot of the dwelling.

Historically, homes first used electricity only for lighting and other small appliances. Next, the convenience of electric cooking ranges, ovens, microwave ovens, water heaters, clothes dryers and air conditions led to a large increase in electrical usage in homes. Just recently, homes have begun installing tankless water heaters for the entire residence. Such devices are no longer the small, low power units designed to fit under a sink, but rather, high volume, high power units designed to replace the conventional water tank style heater. As a result of the tankless heater's design, power requirements have increased six fold or more over the old tank style water heater.

Electrical codes as discussed previously provide specific guidelines for the service rating, i.e. how much power, measured in volt-amperes, that can be supplied by a given size electrical power feeder. For example, a feeder having a service rating of 200 amperes, 240 volts can deliver this power for only intermittent periods of time. Continuous loads are limited to 80% of this maximum rating or 160 amperes.

A typical 2500 square foot residence might have an electric range and oven rated at 50 amperes, a microwave oven at 12 amperes, a dishwasher at 15 amperes, a clothes dryer at 30 amperes, an air conditioner at 50 amperes and an allotment of 3 volt-amperes per square foot or 31 amperes.

It is also recognized that not all appliances operate continuously and thus the following formula is commonly used to take the intermittent use into effect.

Specifically, 100% of the first 10 kVA (42 amperes)plus 40% of the remainder of general loads (39 amperes) and 100% of the heating and air conditioning loads (50 amperes). Adding a conventional 20 ampere tank style water heater adds another 8 amperes (40% of 20) thereby bringing the house load to 139 amperes. Thus, using the maximum continuous feeder load of 160 amperes, there are an additional 21 amperes for miscellaneous appliances and uses.

However, if a tankless water heater is used in place of the tank style heater, the load requirements go from 20 amperes to 120 amperes at 240 volts. Using the 40% load calculation, the increase is an additional 40 amperes and now the total power requirements are 179 amperes which exceeds the feeder rating by 19 amperes and now requires an increase in same to accommodate.

However, even worse, the tankless water heater requirement of 120 amperes is two and a half times as large as the previous largest load. As set forth in the National Electrical Code, section 230–42(a), "Minimum Size and Rating. (a) General. The ampacity of the service-entrance conductors before the application of any adjustment or correction factors shall not be less than either (1) or (2). Loads shall be determined in accordance with Article 220. Ampacity shall be determined from Section 310-15. The maximum allowable current of busways shall be that value for which the busway has been listed or labeled.

(1) The sum of the noncontinuous loads plus 125 percent of continuous loads (2) The sum of noncontinuous load plus the continuous load if the service-entrance conductors terminate in an overcurrent device where both the overcurrent device and its assembly are listed for operation at 100 percent of their rating"

If the tankless water heater operates simultaneously with the air conditioner and the clothes dryer, the load would exceed the feeder rating of 200 amperes. Such usage would be a common occurrence in many households.

The historical increase in power requirements has resulted in redesign or retrofitting of residences to meet this larger electrical power need. One option has been simply to increase the electrical feeder power available to the residence. However, this option has been very costly in terms of retrofitting new wiring and wiring fixtures to meet this increase.

Another option has been to install an interlock system which senses when one appliance, for example, a tankless hot water heater switches on and turns off another, for example, an air conditioner to meet the new demand. This switching is done very quickly in order to keep the total power used by the home below the electrical service rating. Such interlock systems can be very complex with many appliances controlled thereby.

Other systems are described in U.S. Pat. No. 5,504,306 entitled "Microprocessor Controlled Tankless Water Heater System" which issued on Apr. 2, 1996 to Russell et al. which provides an apparatus for controlling a water delivery system utilizing an instant flow tankless water heater which includes a programmable microprocessor with support circuitry to achieve control of the outlet temperature of a varying flow rate and varying inlet temperature stream.

U.S. Pat. No. 5,325,822 entitled "Electric Modular Tankless Fluids Heater" which issued on Jul. 5, 1994 to Fernandez shows a tankless, flow through electric water heater whose housing is designed for modular application, where serially connected modules define the path of the fluid being heated, in this case water, through the heater from inlet to outlet.

U.S. Pat. No. 4,567,350 entitled "Compact High Flow Rate Electric Instantaneous Water Heater" which issued on Jan. 28, 1986 to Todd Jr. discloses a compact, tankless instantaneous type electric water heater for household and commercial use which provides a plurality of individual heating chambers connected in series flow relationship between a cold water inlet and a hot water outlet.

U.S. Pat. No. 5,866,880 entitled "Fluid Heater With Improved Heating Elements Controller" which issued on Feb. 2, 1999 to Seitz et al. shows an electrically powered water heater which includes a controller and a plurality of heating elements for substantially instantaneous heating of fluid passing through the heater; water level sensing circuitry, while the heating elements are incrementally energized/de-energized by means of triacs.

None of the references disclose the present invention.

Thus, there is a need for a new system of handling the increased electrical requirements of the home without (1) increasing the amount of electricity fed into the home and (2) without violating relevant building codes.

The present invention meets this need.

SUMMARY OF THE INVENTION

It is an object of the present invention to provide a system for managing the power requirements of a residence or other building.

It is a further object of the present invention to manage the power requirements of a residence or other building without increasing the amount of electricity fed into the house and without violating relevant building codes.

Further objects and advantages of the invention will become apparent as the following description proceeds and the features of novelty which characterize this invention will be pointed out with particularity in the specification annexed hereto.

DESCRIPTION OF THE PREFERRED EMBODIMENT

Figure 1:
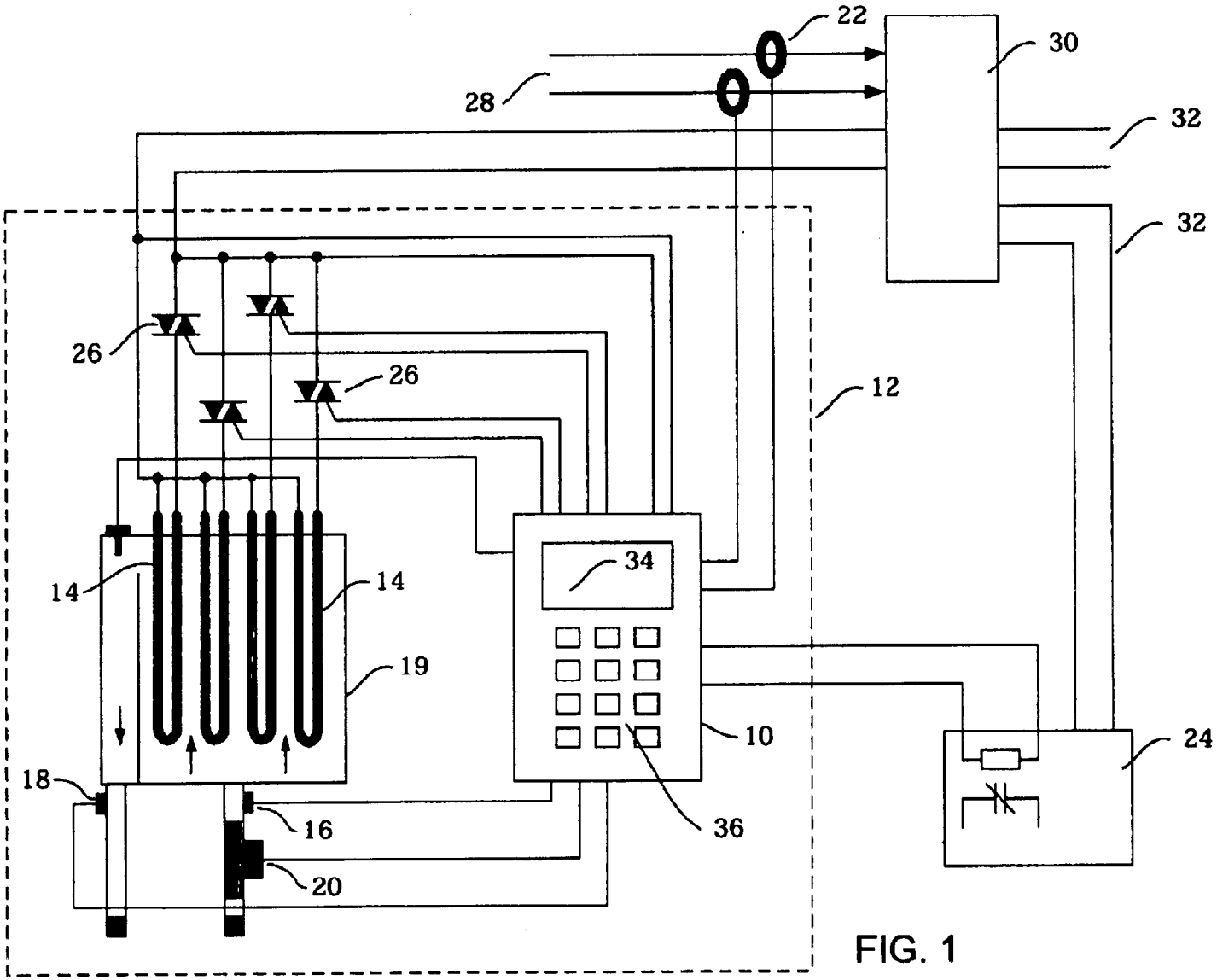
FIG. 1 is a schematic electrical diagram of one embodiment of the present invention.

One embodiment of the present invention is best shown in FIG. 1 in which a power management system 10 is provided for use in connection with a household electrical system 30 for controlling a plurality of household loads 32. In the illustrated example, power management system 10 is shown in use with one of the household loads 32, namely, a specific tankless water heater 12. As is well known in the art, tankless water heater 12 employs a plurality of on demand heating elements 14 positioned proximate to hot water users such as appliances and faucets. On demand heating elements 14 are only actuated when hot water is needed by users. Power management system 10 is a microprocessor having a display 34 and a keypad 36.

For purposes of illustration, power management system 10 is in shown in electrical communication with an inlet temperature sensor 16 and an outlet temperature sensor 18 to a specific hot water appliance 19. Power management system 10 is also in electrical communication with a plurality of other slaved hot water using appliances found in a particular household, including, but not limited to, hot water faucets, showers, dishwashers and the like.

Power management system 10 is also in electrical communication with a flow sensor 20 for determining when water is flowing to the particular hot water user. Flow sensor 20 and temperature sensors 16 and 18 in combination function as a load sensor thereby providing power management system 10 with the data necessary to determine the amount of electrical power needed to accomplish the task at hand.

Lastly, one or more current sensors 22 are used to determine the amount of electrical current available to a home and a variety of electrical control relays supplying power to a plurality of various auxiliary unit loads 32, for example, an air conditioning unit 24.

Power management system 10 is in electrical communication with a plurality of Triacs switches 26 which are used to control the power flowing to other slave heating elements 14 as well as the electrical control relays supplying power to the auxiliary unit loads 32.

In the illustrated example, power management system 10 maintains a clear record of power measurements to calculate the effective load on a main feeder line 28. Power management system 10 further takes into account the ability of home electrical system 30 to handle intermittent maximum loads versus sustained continuous loads. In general, electrical codes allow home electrical system 30 to reach an intermittent maximum rated amperage but only allow a continuous load of 80% of that maximum.

If, in a given situation, the effective load is less than an allowed continuous load, power management system 10 allows an appliance such as tankless water heater 12 to draw full power. If, on the other hand, that effective load exceeds the allowed continuous load number but not the intermittent maximum rate, power management system 10 calculates and maintains a three hour average not to exceed the continuous load number. Power management system 10 accomplishes this goal by using TRIACS 26 to reduce the amperage available to heating elements 14 of tankless water heater 12 as needed to maintain that average even though the water temperature supplied may be reduced. In addition, power management system 10 may temporarily shut off power to a one of the plurality of auxiliary appliances 32, for example, an appliance such as air conditioning unit 24, particularly to avoid allowing an effective load to exceed the intermittent maximum rate.

Figure 2:
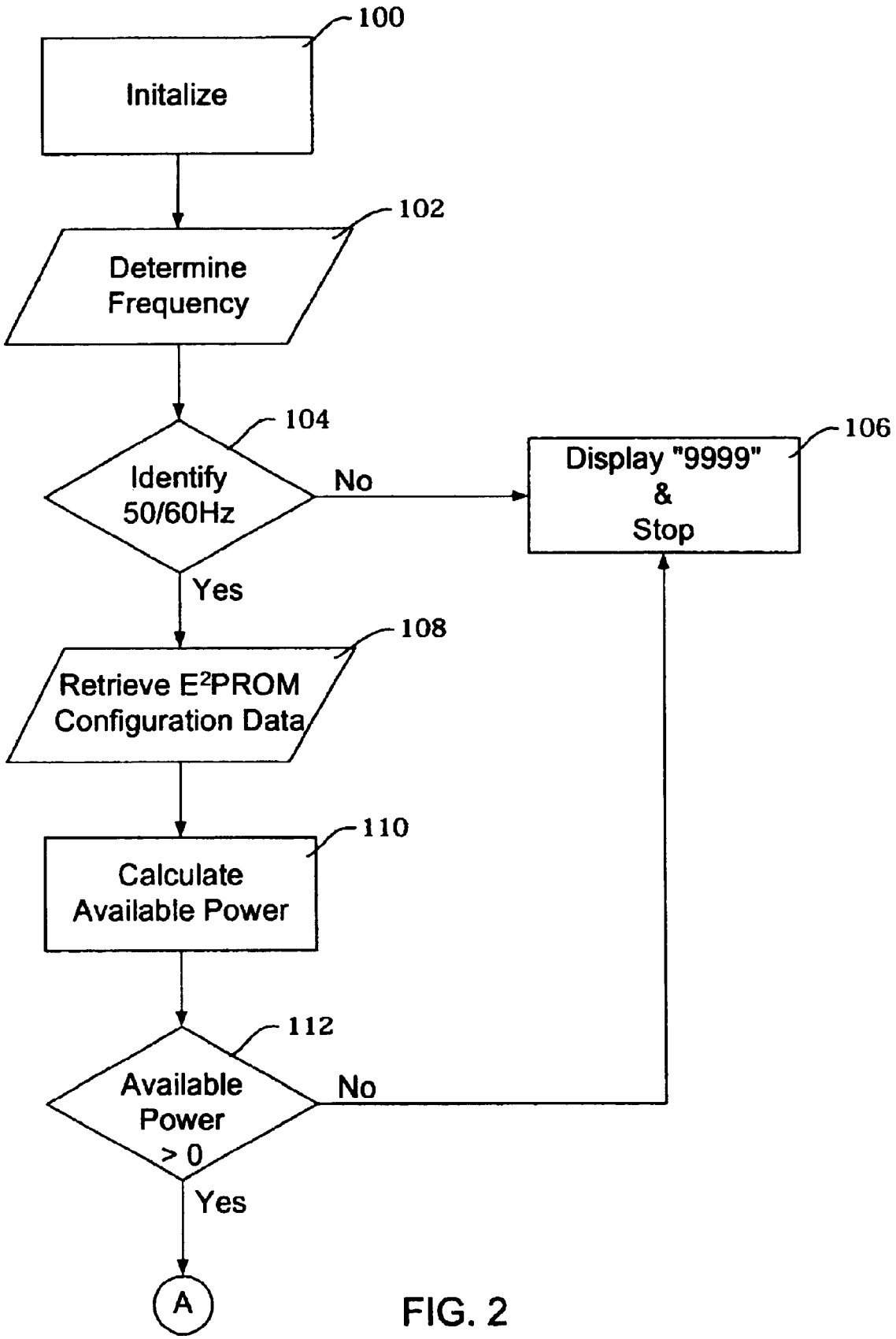
FIG. 2 is a flow chart showing the initialization process for one embodiment of a power management controller used in the present invention.
Figure 3A:
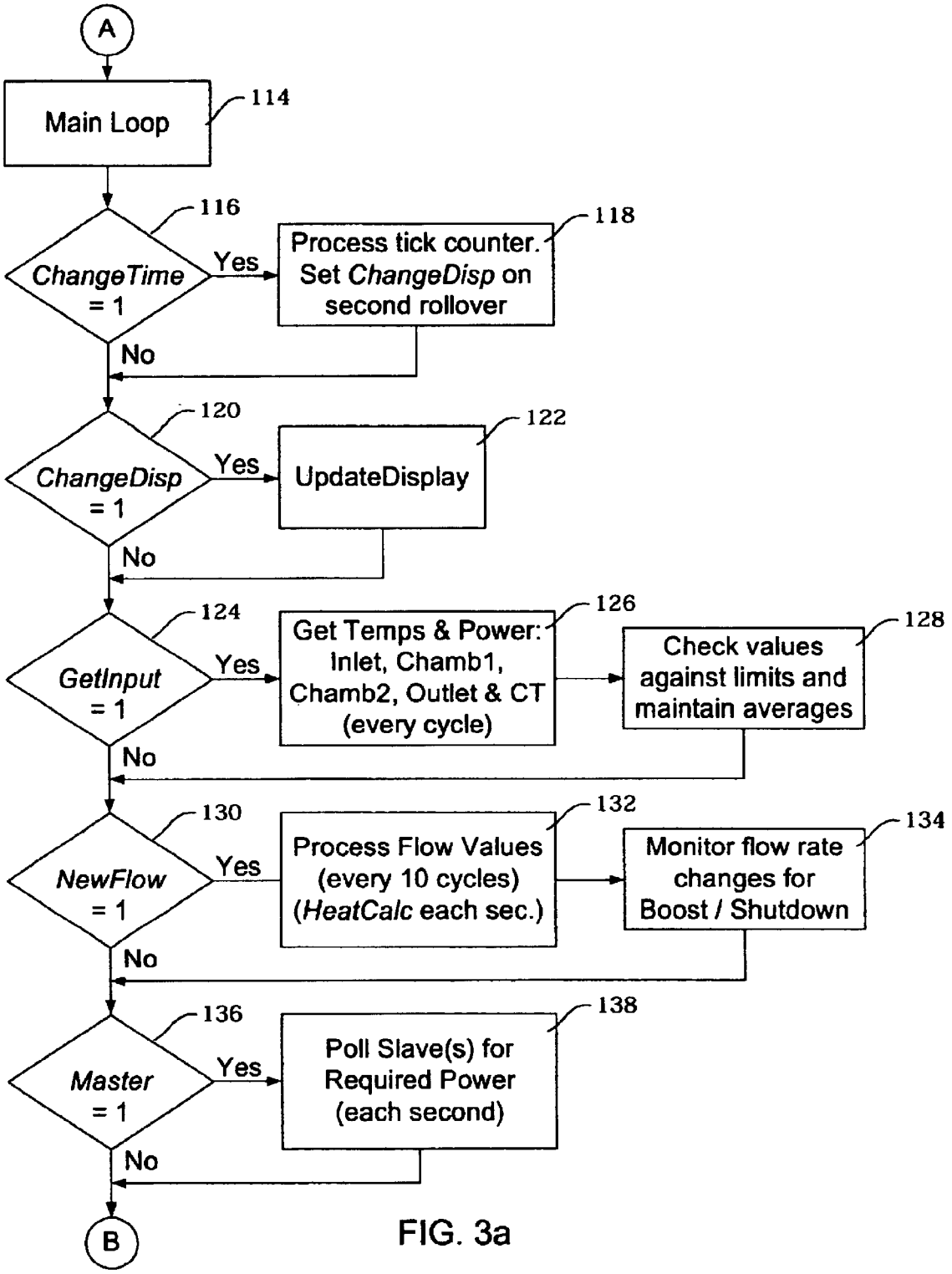
FIG. 3 is a continuation of the flow chart of FIG. 2 showing the main logic flow of the power management controller of FIG. 2.
Figure 3B:
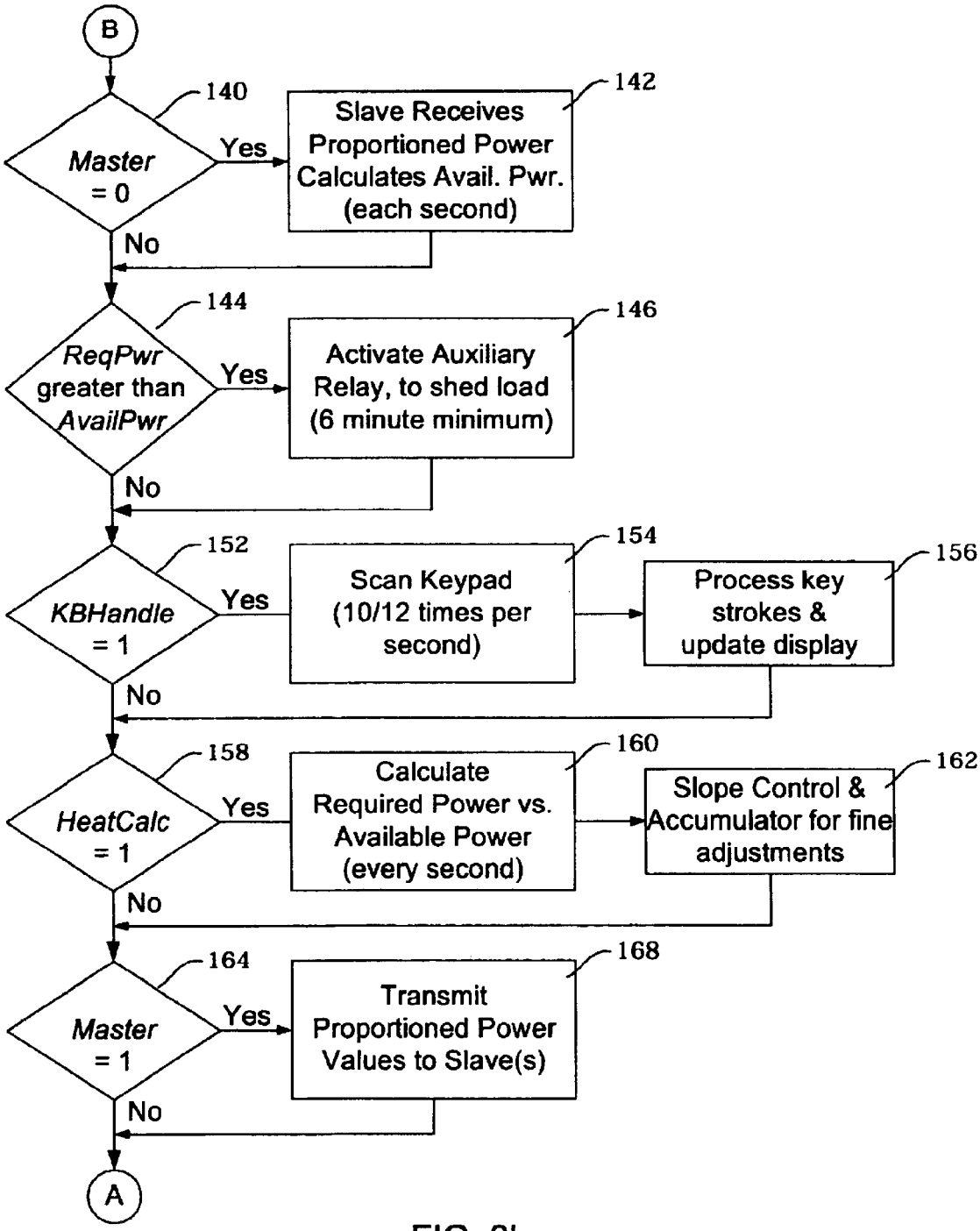

One embodiment of the logic process by which power management system 10 operates is illustrated in FIGS. 2 and 3. Those skilled in the art will recognize that the exact sequence and process shown in FIGS. 2 and 3 is exemplary in nature and the present invention is not limited to such steps.

First, power management system 10 initializes itself as shown in box 100 seen in FIG. 2. Next, power management system 10 uses data from current sensors 22 to determine the frequency of the electricity flowing in the house in box 102. In box 104, the frequency is checked to be certain it is between 50 and 60 hertz. If not, in box 106, power management system 10 stops everything and displays a warning, in the illustrated example, a "9999" display to warn of problems in the home electrical system 30.

If the frequency is acceptable in box 104, in box 108 power management system 10 retrieves its configuration data from an EPROM chip, and uses current sensors 22 to calculate the power available to the household electrical system 30 in box 110. If the available power is less than zero in box 112, i.e., the load on the system is too much, power management system again stops and warns the user of same in box 106. If the available power is greater than zero in box 112, power management system 10 moves onto its main loop in box 114 shown in FIG. 3.

To summarize the loop process steps, power management system 10 checks the status of a series of flags and acts accordingly on each such flag. The first flag is a change time flag checked in box 116. If the change time flag is set, i.e. equals one, power management system 10 processes input from a tick (time) counter and sets the change display flag to one on every other rollover as shown in box 118 and moves on to check the change display flag in box 120. If the change time flag is not set, i.e. equals zero, power management system 10 moves on to check the change display flag shown in box 120.

If the change display flag is set, as, for example, by power management system 10 in box 118, power management system 10 then changes the display to the correct display, i.e., the power use and or temperature, in box 122 and then moves on to check the get input flag in box 124. As the process cycles, the correct display will cycle between temperatures and power at about once per second. If the change display flag is not set, power management system 10 moves on to check the input data flag in box 124.

In box 124, power management system 10 checks if the get input flag is set. If so, power management system 10 obtains relevant data from inlet temperature sensor 16, outlet temperature sensor 18, and current sensors 22 in box 126 at about 60 times per second, i.e. once per cycle. This data is checked against limits on said numbers and checked to certify that the desired averages are being maintained while recalculating available power in box 128. Power management system 10 then moves on to check the new flow flag in box 130. If in box 124 the get input flag is not set, power management system 10 moves directly to the new flow flag in box 130.

In box 130, power management system 10 checks if the new flow flag is set. If so, power management system 10 obtains relevant data from flow sensors 20 and calculates the heat needed to maintain the desired temperature in box 132. Note that this data is averaged from every ⅙ of a second, i.e. about 10 cycles of raw data to minimize inadvertent spikes. This data is compared against prior flow data in box 134 to determine whether the flow has increased or decreased and whether or not to boost the power output or shut said output down. Power management system 10 then moves on to check the master flag in box 136. If in box 130 the new flow flag is not set, power management system 10 moves directly to the master flag in box 136.

In box 136, power management system 10 checks if the master flag is set to one. If so, power management system 10 checks slaved heating elements, generally every second, to determine the power needs of slaves 32. Power management system 10 then moves on to see if the master flag equals zero in box 140. If, in box 136 the master flag is not set to one, power management system 10 moves directly to check if the master flag equals zero in box 140.

In box 140, power management system 10 checks if the master flag equals zero. If so, power management system 10 calculates the available power and computes the proportionate power each slaved heating element requires each second based on the power needs of same from box 138 in box 142. Power management system 10 then moves on to check on whether the required power is greater than the available power in box 144. If so, in box 146, current relays are activated to shed load for auxiliary units, for example, an air conditioner. The shutdown is preferably about six minutes long at a minimum and then power management system 10 moves on to box 152. The six minute minimum is selected to allow adequate time for motors and compressors to reset and cool after shut down. If the required power is less than the available power, power management system 10 moves directly to box 152.

In box 152, power management system 10 checks if the keypad flag is set. If so, power management system 10 scans keypad 36 in box 154 and process the key strokes and updates display 34 in box 156. Power management system 10 then moves on to check the heat calculation flag in box 158. If in box 152 the keypad flag is not set, power management system 10 moves directly to the heat calculation flag in box 158.

In box 158, power management system 10 checks if the heat calculation flag is set. If so, power management system 10 calculates the required power versus the available power in box 160. In box 162, power management system 10 uses and accumulator and slope control for fine tuning of the system. In box 162, power management system 10 compares the temperature versus power curves with the actual values to compare. As is well known, performance of systems tends to degrade over time. By recalculating the slope of the power versus temperature curve, power management system 10 use corrected values for calculating needed power requirements. Power management system 10 then moves to box 164 to again check to see if the master flag is set to one. If so, power management system 10 transmits the proportionate power calculated in box 142 to each slave 32. Power management system then recycles back to box 114 to start the process anew. If master flag does not equal one, then power management system cycles directly back to box 114.

Although only certain embodiments have been illustrated and described, it will be apparent to those skilled in the art that various changes and modifications may be made therein without departing from the spirit of the invention.

What is claimed is:

1. A power management system for controlling the electrical power to an appliance in a building, the power management system comprising;

a microprocessor;

at least one current flow sensor in electrical communication with the microprocessor, the at least one current flow sensor adapted to measure the amount of electrical current available to the building as well as the actual current flowing through the building;

a load sensor in electrical communication with the microprocessor, the load sensor adapted to measure the load requirements of the appliance;

one or more switches in electrical communication with the microprocessor, the one or more switches adapted to control the power flowing to the appliance;

the microprocessor maintaining a record of the information from the load sensor and the one or more current sensors, the microprocessor having predetermined a electrical maximum limit and a continuous load limit for the building, the microprocessor using the one or more switches to average a continuous load over three hours which is less than the continuous load limit for said building while never exceeding the electrical maximum limit for said building.

2. The power management system of claim 1 wherein the household appliance is a tankless hot water heater.

3. The power management system of claim 2 wherein the load sensor comprises, in combination, an inlet water temperature sensor, an outlet water temperature sensor and a flow sensor.

4. The power management system of claim 2 wherein the tankless water heater includes a plurality of on demand heating elements.

5. The power management system of claim 1 wherein the microprocessor has a display and a keypad.

6. The power management system of claim 1 wherein the one or more switches are triacs.

7. The power management system of claim 1 wherein the continuous load limit is 80% of the electrical maximum limit.

8. The power management system of claim 1 further comprising a controller in electrical communication with the microprocessor and a second electrical appliance in the building, the microprocessor having the ability to instruct the controller to shut down the second electrical appliance to reduce the electrical load on the building.

9. A power management system for controlling the electrical power to a tankless hot water heater having a plurality of on demand heating elements in a building, the power management system comprising;

a microprocessor;

at least one current flow sensor in electrical communication with the microprocessor, the at least one current flow sensor adapted to measure the amount of electrical current available to the building as well as the actual current flowing through the building;

an inlet water temperature sensor, an outlet water temperature sensor and a flow sensor in electrical communication with the microprocessor, the inlet water temperature sensor, the outlet water temperature sensor and the flow sensor adapted to measure the load requirements of the tankless hot water heater;

or more triacs in electrical communication with the microprocessor, the one or more triacs adapted to control the power flowing to the plurality of heating elements of the tankless hot water heater;

the microprocessor maintaining a record of the information from the inlet water temperature sensor, the outlet water temperature sensor, the flow sensor and the one or more current sensors, the microprocessor having predetermined a electrical maximum limit and a continuous load limit which is 80% of the electrical maximum limit for the building, the microprocessor using the one or more triacs to average a continuous load over three hours which is less than the continuous load limit for said building while never exceeding the electrical maximum limit for said building.

10. The power management system of claim 9 wherein the microprocessor has a display and a keypad.

11. The power management system of claim 9 further comprising a controller in electrical communication with the microprocessor and a second electrical tankless hot water heater in the building, the microprocessor having the ability to instruct the controller to shut down the second electrical appliance to reduce the electrical load on the building.

* * * * *